US005327203A

United States Patent [19]

Rasch et al.

[11] Patent Number: 5,327,203

[45] Date of Patent: Jul. 5, 1994

[54] WEB RELEASE AGENT SYSTEM FOR A HEAT AND PRESSURE FUSER

[75] Inventors: Kenneth R. Rasch; Frederick C. DeBolt, both of Fairport, N.Y.

[73] Assignee: Xerox Corporation, Stamford, Conn.

[21] Appl. No.: 151

[22] Filed: Jan. 4, 1993

[51] Int. Cl.[5] ..... G03G 15/20

[52] U.S. Cl. ..... 355/283; 118/257

[58] Field of Search ..... 355/283, 284; 118/257; 428/229

[56] References Cited

U.S. PATENT DOCUMENTS

| | | | |
|---|---|---|---|
| 3,941,558 | 3/1976 | Takiguchi | 432/60 |
| 4,393,804 | 7/1983 | Nygard et al. | 118/60 |
| 4,557,588 | 12/1985 | Tomosada | 355/14 |
| 4,686,132 | 8/1987 | Sumii et al. | 428/171 |
| 4,939,552 | 7/1990 | Nakanishi | 355/300 |
| 5,045,890 | 9/1991 | DeBolt et al. | 355/284 |
| 5,049,944 | 9/1991 | DeBolt et al. | 355/284 |
| 5,218,410 | 6/1993 | Nakabayashi et al. | 355/283 |

FOREIGN PATENT DOCUMENTS

| | | |
|---|---|---|
| 58-184173 | 10/1983 | Japan . |
| 61-251881 | 11/1986 | Japan . |

*Primary Examiner*—Joan H. Pendegrass

[57] ABSTRACT

A web release agent delivery system for a heat and pressure fuser. The system includes an oil impregnated web which is transported between supply and take-up rolls while contacting the fuser roll. The web is formed of a material having sub-denier fibers. It is preferred that the web is formed of a polyaramid fiber material with a polyester binder wherein some of the polyaramid fibers are of a sub-denier thickness. The preferred composition of the material is approximately 70% polyester and 30% polyaramid with approximately 50% of the polyaramid fibers having a denier ranging between approximately 0.8 and 0.25 denier. The disclosed material having an improved oil retaining capacity and donor capacity as used in a web release agent delivery system for a heat and pressure fuser.

5 Claims, 3 Drawing Sheets

WEB RELEASE AGENT SYSTEM FOR A HEAT AND PRESSURE FUSER

The present invention relates to a fuser apparatus for electrophotographic printing machines and in particular to a release agent web delivery system for a heat and pressure roll fuser.

The following patents and patent applications are hereby incorporated herein by reference thereto:

U.S. patent application Ser. No. 08/000,343, filed on the same date as the present application, entitled FUSER MECHANISM HAVING CROWNED ROLLS, and assigned to Xerox Corporation;

U.S. Pat. No. 5,045,890, issued Sep. 3, 1991 to DeBolt et al., and assigned to Xerox Corporation; and U.S. Pat. No. 5,049,944, issued Sep. 17, 1991 to DeBolt et al., and assigned to Xerox Corporation.

BACKGROUND OF THE INVENTION

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member or substrate permanently by heat, it is necessary to elevate the temperature of the toner material to a point at which constituents of the toner material coalesce and become tacky. This action causes the toner to flow to some extent onto the fibers or pores of the substrate or otherwise upon the surfaces thereof. Thereafter, as the toner material cools, solidification of the toner material occurs causing the toner material to be bonded firmly to the substrate.

One approach to thermal fusing of toner material images onto the supporting substrate has been to pass the substrate with the unfused toner images thereon between a pair of opposed roller members at least one of which is internally heated. During operation of a fusing system of this type, the substrate to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with a compliant material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about 1 micron to act as a toner release material. These materials posses a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface.

Various systems have been used to deliver release agent fluid to the fuser roll including the use of oil soaked rolls and wicks with and without supply sumps as well as oil impregnated webs. The oil soaked rolls and wicks generally suffer from the difficulty in that they require a sump of oil to replenish the roll and the wick as its supply of release agent is depleted by transfer to the fuser roll. Furthermore, a wick suffers from the difficulty of a relatively short life of the order of around 10,000 prints. Moreover, these systems suffer from the further difficulty in that their surfaces in contact with the fuser roll are constant whereby contamination particularly by toner and paper can readily occur further reducing valuable life.

In a web release agent delivery system, one end of the web is attached to a take-up member while the rest of the web is supported on a supply member. A portion of the web intermediate the supply and take-up members is held in pressure engagement with the heated fuser roll structure to both apply release agent material to the fuser roll surface and clean debris therefrom. These delivery systems have suffered from various material related problems. That is, the delivery of oil, i.e., quantity released, is not of a high percentage of oil held, the delivery is not substantially uniform, and the like.

The following references may be of relevance to the present invention:

U.S. Pat. No. 3,941,558, Patentee: Takiguchi, Issued: Mar. 2, 1976.

U.S. Pat. No. 4,393,804, Patentee: Nygard et al, Issued: Jul. 19, 1983.

U.S. Pat. No. 4,557,588, Patentee: Tomosada, Issued: Dec. 10, 1985.

U.S. Pat. No. 4,939,552, Patentee: Nakanishi, Issued: Jul. 3, 1990.

U.S. Pat. No. 5,045,890, Patentee: DeBolt et al., Issued: Sep. 3, 1991.

U.S. Pat. No. 5,049,944, Patentee: DeBolt et al., Issued: Sep. 17, 1991.

JPPN-58-184173 (A), Patentee: Katou, Published: Oct. 27, 1983.

JPPN-61-251881 (A), Patentee: Takizawa Published: Nov. 8, 1986.

The foregoing references may be summarized as follows:

U.S. Pat. No. 3,941,558 discloses a rolled web impregnated with silicone oil for preventing offset. The web has a thickness of two mm, a total length of 50 cm, and travels one cm per thousand copies between the supply and take-up rollers. This system transfers about 0.003 cc of oil to the fuser per copy.

U.S. Pat. No. 4,393,804 discloses a rolled web system that moves between a supply core and take-up roller. A felt applicator supplies oil from a supply reservoir to the web. The take-up core is driven by a slip clutch at a speed greater than the speed of the pressure roller, thus exerting tension on the web. The web is between one and two mm in thickness and moves at a constant speed of 5 cm per 200 to 1,000 copies.

U.S. Pat. No. 4,557,588 discloses an image forming apparatus such as an electrophotographic copier, microfilm equipment, recording equipment, facsimile or printer. A movable cleaning member is maintained in contact with a member to clean its surface and the movement of the cleaning member is variably controlled according to the state of the image formation.

U.S. Pat. No. 4,939,552 discloses a cleaning device for cleaning the surface of an element of a copying apparatus to be cleaned by contacting a cleaning web therewith is connected to a driving mechanism of a scanning member of the coping apparatus and is driven in correlative movement with the scanning member. It is driven only when the scanning member returns to its original position by a one way clutch and by a constant amount of movement irrespective of the amount of movement of the scanning member.

U.S. Pat. No. 5,045,890 discloses a fuser apparatus for applying offset preventing liquid to a fuser roll including: a supply core; a rotatable take-up core; an oil impregnated web member adapted to be moved from the supply core to the take up core; a motor mechanically coupled to the take up roll for driving the web member from the the supply core to the take up core; a pressure roll in engagement with the web member and positioned to provide a contact nip for the web member with the fuser roll opposite the pressure roll wherein the contact of the web member with the fuser roll transfers oil from the web member to the fuser roll, and control means to vary the duty cycle operation of the motor to drive the web member at a relatively constant linear speed at the contact nip, the control means including a timer to monitor the cumulative time of operation of the motor and means to progressively decrease the duty cycle of the motor in response to the cumulative time of operation wherein the progressively decreased duty cycle of operation compensates for the increasing radius of the web member on the take up roll to maintain said relatively constant linear speed at the contact nip.

U.S. Pat. No. 5,049,944 discloses apparatus for applying offset preventing liquid to a fuser roll including an oil impregnated web to be moved relative to a fuser roll. A timer is employed to monitor the cumulative time of operation of a motor used to drive the web relative to the fuser roll and to progressively decrease the cycle of the motor so that essentially a uniform amount of the web is moved at each cycle.

JPPN-58-184173 (A) discloses a fuser apparatus in which one of the rolls is crowned in the center and the other is flared toward one end. The flared roller is also mounted at an angle to the center line of the crowned roller.

JPPN-61-251881 (A) discloses a fixed roller having an inverted crow shape along its length, which engages a belt entrained about two crown shaped rollers to act a part of a fixing device.

Additionally, there are several automatic printing machines commercially available, such as the Xerox 5028 model copier, which employ webs for providing release agents to fuser rolls. Other examples of such commercial devices, presently or currently available, include the Canon model 3225, 3725, 3000 series, 4000 series and 5000 series products. These products also all have liquid release agent impregnated webs supported between a supply roll and a take-up roll and urged into contact with the fuser roll by an open celled foam pinch roll.

In accordance with one aspect of the present invention there is provided apparatus for applying offset preventing liquid to a fuser roll comprising an oil impregnated web material including sub-denier fibers and means for urging the web material into contact with the fuser roll to apply release material to the fuser roll. This aspect can further include the sub-denier fibers being of a size ranging from about 5% and 50% of said web material by weight. Further, the web material can comprise a non-woven material, which can be formed of polyaramid fibers and a polyester fiber binder. In addition the polyester fiber binder can comprise approximately 70% of the web material by weight with the fibers thereof being approximately 1.5 denier. The invention can also include a take up roll adapted to receive the web material and a supply roll for storing a supply of the web material, as well as, comprising means for advancing portions of the web member from the supply roll and into contact with the fuser roll and, subsequently, to the takeup roll so as to position unused portions of the web material in contact with the fuser roll. The subdenier fibers can comprise approximately 15% of the web material by weight and can be polyaramid fibers ranging from about 0.25 to about 0.80 denier, and preferably 0.5 denier.

BRIEF DESCRIPTION OF THE DRAWINGS

Other aspects of the present invention will become apparent as the following description proceeds and upon reference to the drawings, in which.

Figure 1:
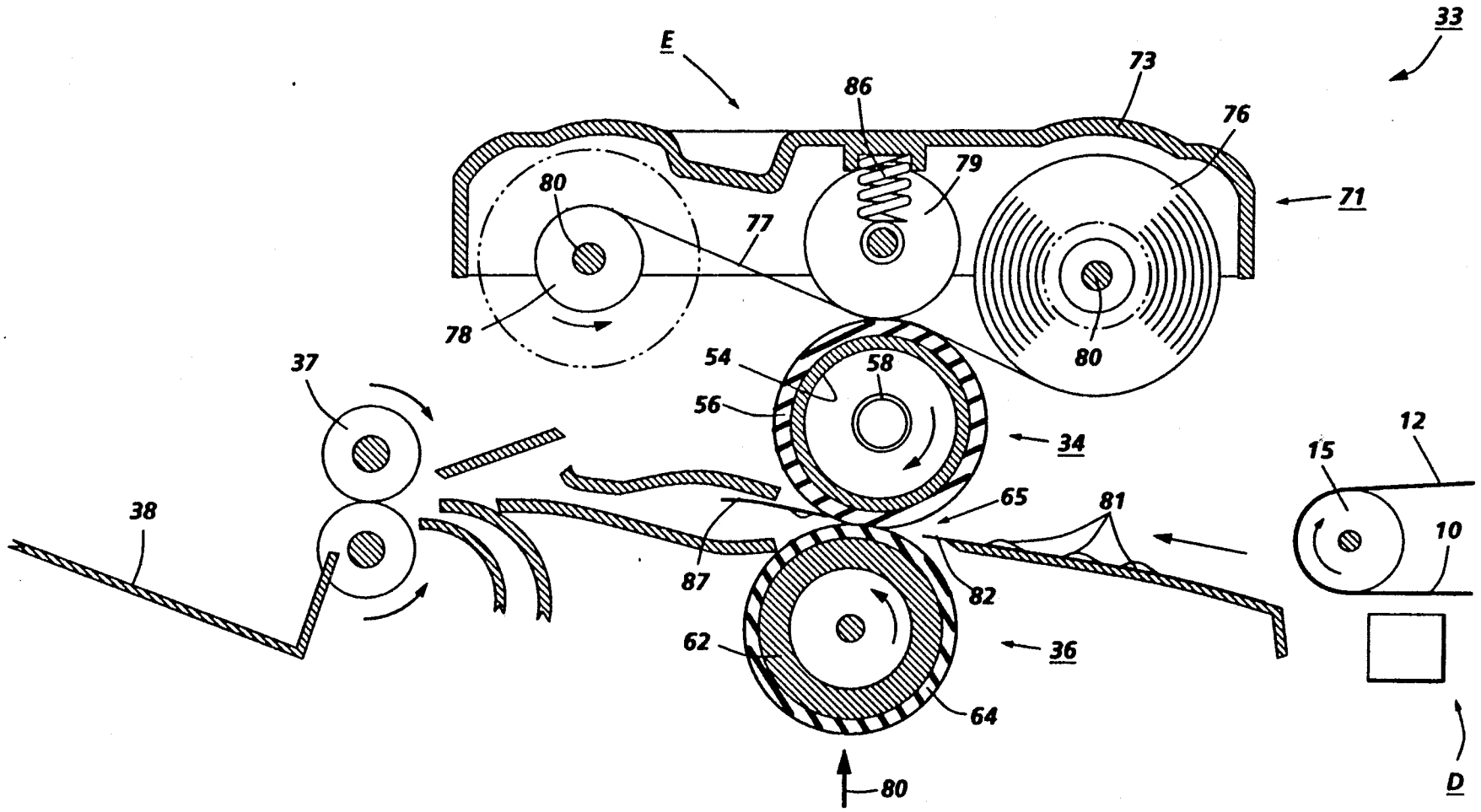
FIG. 1 is a schematic elevational view, partially in section incorporating the features of the present invention therein.

While the present invention will be described in connection with the preferred embodiment thereof, it will be understood that it is not intended to limit the invention to that embodiment. On the contrary, it is intended to cover all embodiments, modifications, and equivalents as may be included within the spirit and scope of the invention as defined by the appended claims. For a general understanding of the features of the present invention, references should be made to the drawings.

In the drawings, like numerals have been used to identify identical elements.

DETAILED DESCRIPTION

Figure 3:
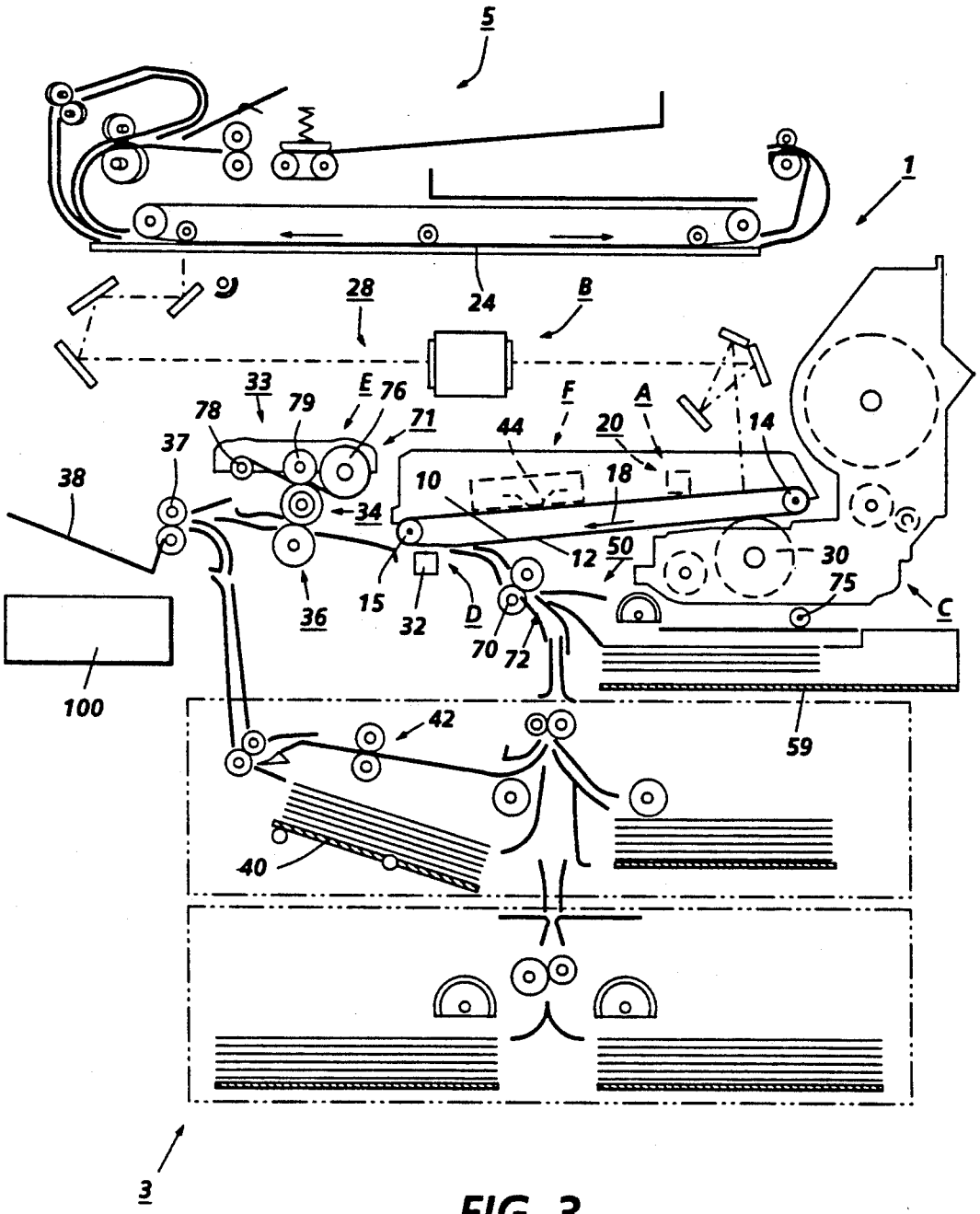
FIG. 3 is a schematic elevational view depicting an illustrative electrophotographic printing machine incorporating the delivery system of the present invention in the fuser assembly thereof.

FIG. 3 schematically depicts an illustrative electrophotographic printing machine of the type in which the present invention may be employed. Specifically, the printing machine 1 of FIG. 3 has both a copy sheet handling system 3 and a document handling system 5 for transporting sheets of material such as paper, Mylar and the like, to and from processing stations of the machine 1. The machine 1, has conventional imaging processing stations associated therewith, including a charging station A, an imaging/exposing station B, a development station C, a transfer station D, a fusing station E, and a cleaning station F. It will be understood that a finishing/sorter station can be incorporated for use with the present machine in a known manner. The machine 1 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 1 can be briefly described as follows:

The photoconductive belt 10 is charged at the charging station A by a corona generating device 20. The charged portion of the belt is then transported by action of the drive roller 14 to the imaging/exposing station B where a latent image is formed on the belt 10 corresponding to the image on a document positioned on a platen 24 via the light lens imaging system 28 of the imaging/exposing station B. It will also be understood that the light lens imaging system can easily be changed to an input/output scanning terminal or an output scanning terminal driven by a data input signal to likewise image the belt 10.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy sheet handling system 3. In this case, a corona generating device 32 is provided to attract the toner image from the photoconductive belt 10 to the copy sheet substrate. The copy sheet substrate is transported along either path 50 or 72 to the registration rolls 70 for passage through the transfer station D.

The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to the output tray 38 or along a selectable duplex path (i.e., tray 40 and path 42 in the case of the illustrative printing machine of FIG. 3) for duplexing. The portion of the belt 10 which bore the developed image is then advanced to the cleaning station F where residual toner and charge on the belt is removed by a blade edge 44 and a discharge lamp (not shown). The cycle is then repeated.

Attention is now directed to FIG. 1 from which the invention will be explained in greater detail. Specifically, a heat and pressure fuser apparatus 33, including a web release agent delivery system therefor are schematically illustrated. As shown in FIG. 1, the fuser apparatus 33 comprises a heated fuser roll 34 which is composed of a core 54 having coated thereon a thin layer 56 of an elastomer. The core 54 may be made of various metals such as iron, aluminum, nickel, stainless steel, etc., and various synthetic resins. Aluminum is preferred as the material for the core 54, although this is not critical. The core 54 is hollow and a heating element 58 is generally positioned inside the hollow core to supply the heat for the fusing operation. Heating elements suitable for this purpose are known in the art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The thin fusing elastomer layer may be made of any of the well known materials, for example, RTV and HTV silicone elastomers.

The fuser roll 34 is shown in a pressure contact arrangement with a pressure roll 36. The pressure roll 36 comprises a metal core 62 with a layer 64 of a heat-resistant material. In this assembly, both the fuser roll 34 and the pressure roll 36 are mounted on bearings (not shown). The pressure roll bearings are mechanically loaded, as schematically indicated by the arrow 80 so that the fuser roll 34 and pressure roll 36 are pressed against each other under sufficient pressure to form a nip 65. It is in this nip that the fusing or fixing action takes place with toner images contacting the heated fuser roll 34. The layer 64 may be made of any of the well known materials such as fluorinated ethylene propylene copolymer or silicone rubber.

It is preferred that the fuser and the pressure roll used in conjunction with this invention are of the type described in U.S. patent application Ser. No. 08/000,343, filed on the same date as the present application, entitled FUSER MECHANISM HAVING CROWNED ROLLS with the same named inventors as herein, assigned to Xerox Corporation, which has been incorporated by reference herein. That is, both the fuser roll and the pressure roll have a crown profiled engaging surfaces to form a substantially uniform nip across their lengths and provide a substantially constant nip force and a substantially uniform velocity profile to sheets passing through the nip. However, it will also be understood that the present invention can be used in conjunction with a wide variety of fuser configurations needing a delivery of release fluid to the fuser apparatus.

The liquid release agent delivery or management system 71 of the present invention comprise a housing 73 containing release agent material, for example, silicone oil, which is impregnated in a web of material 77. The web of material 77 applies the release agent to the surface of the fuser roll 34. The web of material 77 is drawn from supply 76 to a take up roll 78. The web material 77, as previously mentioned, is impregnated with silicone oil and upon contact with the fuser roll 34, it delivers silicone oil thereto. The web material 77 contacts the fuser roll 34 at a nip formed between the fuser roll 34 and a pinch roll 79. Pinch roll 79 is formed of an open cell material for carrying a thin coating of silicone. The liquid release agent may be selected from those materials which have been conventionally used. Typical release agents include a variety of conventionally used silicone oils including both functional and non-functional oils. Thus, the release agent is selected to be compatible with the rest of the system.

The web release agent delivery system 71 for delivery of preferably a liquid release agent of the present invention comprises a housing 73 which may typically be a one-piece molded member having mounting elements such as slots or holes (not shown) for a web supply roll 76, a web take-up roll 78 and an open celled foam pinch roll 79. The movable web 77 is urged into delivery engagement with the fuser roll 34 by the open cell foam pinch roll 79 positioned on the side of the web 77 opposite the fuser roll 34.

The supply roll 76 and take-up roll 78 are each made from interchangeable rotatable tubular support core 80 to enable the reversibility of the web. The supply roll core 80 has a supply of release agent impregnated web material 80 wound around the core and is back tensioned within the housing to resist unwinding by suitable means. The foam pinch roll 79 is spring biased toward the fuser roll by two coil springs 86 (only one being shown), one at each end of the pinch roll mounting slot to apply pressure between the web 77 and the fuser roll 34 to insure delivery of an adequate quantity of release agent to the fuser roll and cleaning thereof.

The take-up roll 76 is mounted for rotation in the counterclockwise direction in order to transport the web 77 in the direction of the arrow 88. While the web is illustrated as being moved in the the "against" direction relative to the fuser roll 34 it will be appreciated that it could also be moved in the "with" direction. Suitable bearings, gears and a motor (not shown) are provided to advance the impregnated web 77 from the supply roll 76 to the take-up roll 78. The system 71 may be fabricated in accordance with the system disclosed in U.S. Pat. Nos. 5,045,890 and 5,049,944, incorporated herein by reference.

The open cell foam pinch roll may be made of any suitable material which is resistant to high temperatures of the order of the fusing temperature at 225° C. and does not take a permanent set. Typically, it is a molded silicone rubber foam with open about 0.5 millimeters in their maximum dimension cells to enable the storage of release agent.

The liquid release agent may be selected from those materials which have been conventionally used. Typical release agents include a variety of conventional used silicone oils including both functional and non-functional oils. Thus, the release agent is selected to be compatible with the rest of the system. A particularly preferred release agent is an unimodal low molecular weight polysiloxane having a viscosity of about 11,000 centistokes available from Dow Corning Corporation. For example, such a release agent has been used with the above described release agent delivery system in connection with a 320 mm long and 32 mm diameter fuser. The web in this case is about 0.06 mm thick and impregnated with at least 32 grams pre square meter of release agent, and a 20 mm open cell pinch roller impregnated with release were used. The rate of release consumption was approximately 0.3 microliters per copy.

Figure 2B:
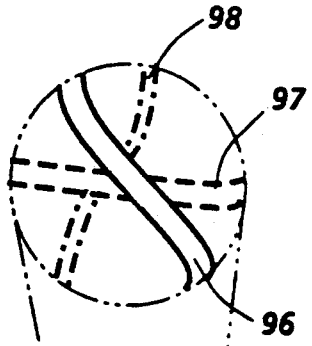
FIG. 2B is an enlarged fragmentary elevational view of the portion of the web material.
Figure 2A:
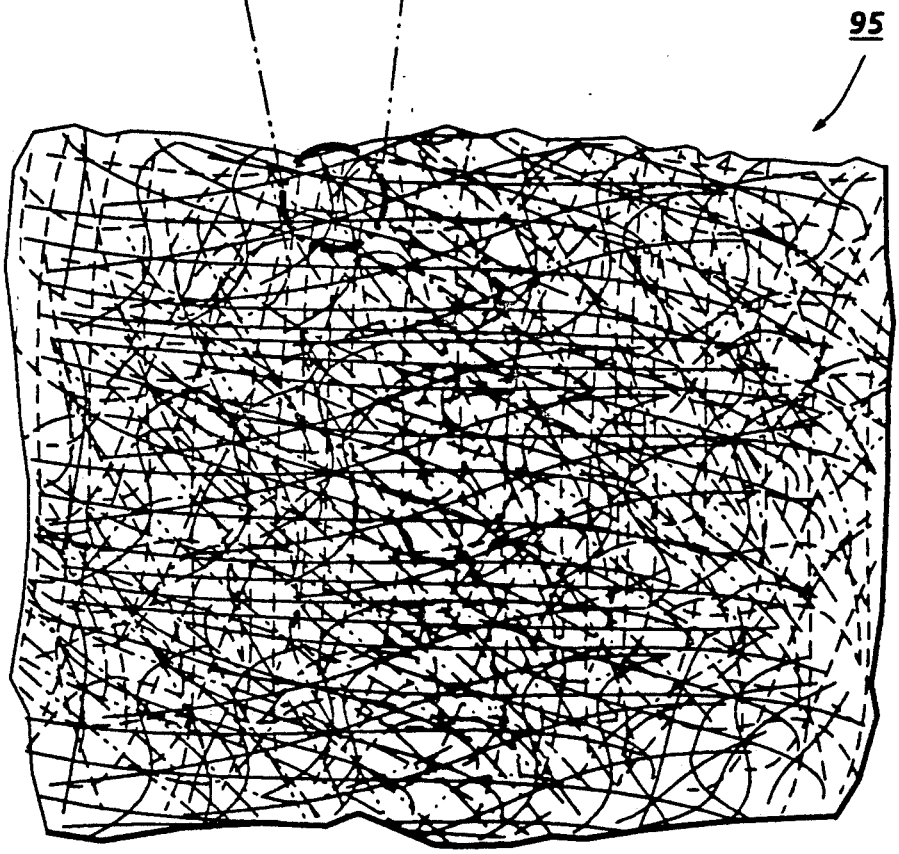
FIG. 2A is an enlarged elevational view of the web material used in the FIG. 1 delivery system.

Referring now to FIG. 2A, a portion of the web material 95 is shown. The material 95 of the web 77 in this instance is formed with fibers 96, 97 and 98 as shown in FIG. 2B. Of these fibers, between at least 5% to 55% by weight of them are sub-denier fibers 98 with the size of the sub-denier fibers ranging from about 0.25 denier to 0.8 denier as represented in the inset to FIG. 2. The material is impregnated with at least 25 grams per meter square of liquid release agent. The material may be woven or non-woven variety and of a sufficient thickness to provide a minimum amount of release agent for a desired life.

For example, previously a web available from Japan Vilene Corporation was used having denier fibers in the 1.5 denier range in a non-woven aramid material with polyester fiber binder, the oil content was approximately 31 grams per square meter with a thickness of, 0.07 mm. Thus, with a roll approximately 13 to 14 meters long and with an oil extraction rate of between 30 to 40%, the useful life of the roll was approximately 100,000 copies.

Whereas, Applicants in accordance with the present invention, have found that a material available from BMP of America located in Medina, N.Y. which has a content of approximately 70% polyester (1.5 denier fibers) as the binder (see fiber 96 of the inset to FIG. 2B) and 30% polyaramid in a non-woven arrangement with about half of the polyaramid being 1.5 denier fibers (see fiber 97 of the inset to FIG. 2B) and the other half of the polyaramid being approximately 0.5 denier fibers (see fiber 98 in the inset to FIG. 2B) improves the webs saturability and suitability, significantly. That is, such material can be impregnated with in excess of 35 grams per square meter of silicon oil and, most significantly, donate or have extracted therefrom in the described delivery system approximately 60% of the available silicon oil. This significantly reduces required web usage, as a slower advance than previously used can be employed and further improves the performance of the fuser assembly. Thus, for the web material described, it has been found to be capable of holding 35 grams or more of release agent per square meter. Thus, the material having a thickness of approximately 0.06 millimeters and between about 13 to 14 meters in length will provide a quantity of release agent capable of fusing about between 120,000 and 150,000 prints. It should be understood that the principle function of the web is the delivery of the release agent and that a cleaning function wherein the fuser roll is cleaned is secondary. In any event, the use of sub-denier fiber in the web significantly improves the performance and cost effectiveness of the release agent delivery system and the overall fuser assembly in which it is incorporable.

In recapitulation, there has been described a web release agent delivery system for use in fuser assemblies comprising an oil impregnated web member formed of a material having sub-denier fibers and a pressure roll in engagement with the web member and positioned to provide a contact nip for the web member with the fuser roll opposite the pressure roll wherein the contact of the web member with the fuser roll transfers oil from the web member to the fuser roll. The sub-denier fibers are in a range from approximately 0.25 deniers to 0.80 deniers and comprise in a range between 5% and 50% by weight of the web material. The web material is a non-woven polyaramid material with polyester fiber binder. The web material is mounted on a take up roll and a supply roll so that portions of the web member from the supply roll are drawn toward and onto the takeup roll so as to position fresh portions of the web material in the contact nip.

It is, therefore, apparent that there has been provided in accordance with the present invention, an improved an improved release agent delivery system having an improved web material for use in a fuser apparatus of the type used in electrophotographic printing machines that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. Apparatus for applying offset preventing liquid to a fuser roll, comprising:

a non-woven oil impregnated web material including sub-denier fibers ranging from about 5% and 50% of said web material by weight, said web material comprises polyaramid fibers and a polyester fiber binder, said polyester fiber binder comprises approximately 70% of said web material by weight with the fibers of said polyester binder being approximately 1.5 denier; and means for urging said web material into contact with the fuser roll to apply release material to the fuser roll.

2. The apparatus of claim 1, further comprising:

a take up roll adapted to receive said web material; and a supply roll for storing a supply of said web material.

3. The apparatus of claim 2, further comprising means for advancing portions of said web member from said supply roll and into contact with the fuser roll and, subsequently, to said takeup roll so as to position unused portions of said web material in contact with the fuser roll.

4. The apparatus of claim 1, wherein said sub-denier fibers comprise approximately 15% of said web material by weight.

5. Apparatus for applying offset preventing liquid to a fuser roll, comprising:

an oil impregnated web material including sub-denier fibers ranging from about 5% and 50% of said web material by weight, said sub-denier fibers comprise polyaramid fibers ranging from about 0.25 to about 0.80 denier, said polyaramid fibers are approximately 0.5 denier; and means for urging said web material into contact with the fuser roll to apply release material to the fuser roll.

* * * * *